US009107005B2

(12) United States Patent
Kano et al.

(10) Patent No.: US 9,107,005 B2
(45) Date of Patent: Aug. 11, 2015

(54) SPEAKER

(71) Applicant: Panasonic Corporation, Osaka (JP)

(72) Inventors: Sawako Kano, Hyogo (JP); Toshiyuki Matsumura, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 4 days.

(21) Appl. No.: 14/110,462

(22) PCT Filed: Jan. 29, 2013

(86) PCT No.: PCT/JP2013/000460
§ 371 (c)(1),
(2) Date: Oct. 8, 2013

(87) PCT Pub. No.: WO2013/121715
PCT Pub. Date: Aug. 22, 2013

(65) Prior Publication Data

US 2014/0029773 A1 Jan. 30, 2014

(30) Foreign Application Priority Data

Feb. 15, 2012 (JP) ..... 2012-030258

(51) Int. Cl.

| | |
|---|---|
| ***H04R 25/00*** | (2006.01) |
| ***H04R 17/00*** | (2006.01) |
| ***H04R 17/04*** | (2006.01) |
| *H04R 7/06* | (2006.01) |

(52) U.S. Cl.
CPC ..... *H04R 17/00* (2013.01); *H04R 17/04* (2013.01); *H04R 7/06* (2013.01)

(58) Field of Classification Search
USPC ..... 381/190, 173, 114
See application file for complete search history.

(56) References Cited

U.S. PATENT DOCUMENTS

| | | | | |
|---|---|---|---|---|
| 4,700,177 | A * | 10/1987 | Nakashima et al. | 340/388.3 |
| 5,804,906 | A * | 9/1998 | Tsutsumi | 310/322 |
| 2010/0246863 | A1 | 9/2010 | Onishi et al. | |
| 2012/0057730 | A1 | 3/2012 | Fujise et al. | |

FOREIGN PATENT DOCUMENTS

| | | |
|---|---|---|
| JP | 54-086292 | 7/1979 |
| JP | 60-134700 | 7/1985 |
| JP | 62-006600 | 1/1987 |
| WO | 2009/063905 | 5/2009 |
| WO | 2010/137242 | 12/2010 |

OTHER PUBLICATIONS

International Search Report issued Mar. 5, 2013 in International (PCT) Application No. PCT/JP2013/000460.

* cited by examiner

*Primary Examiner* — Davetta W Goins
*Assistant Examiner* — Amir Etesam
(74) *Attorney, Agent, or Firm* — Wenderoth, Lind & Ponack, L.L.P.

(57) ABSTRACT

A speaker 10 includes: a plurality of piezoelectric diaphragms 11 and 12 each including a substrate and a piezoelectric element provided on at least one surface of the substrate; one or a plurality of connecting members 13 connecting the plurality of piezoelectric diaphragms 11 and 12 to each other such that the plurality of piezoelectric diaphragms 11 and 12 aligned from the piezoelectric diaphragm 11 located at a frontmost side of the speaker 10, in a thickness direction of the piezoelectric diaphragm 11, and the piezoelectric diaphragms 11 and 12 adjacent to each other face each other at an interval; a support member 16 supporting the back-side diaphragm 12 that is a piezoelectric diaphragm at a backmost side of the speaker 10. The plurality of piezoelectric diaphragms 11 and 12 include two piezoelectric diaphragms 11 and 12 having stiffnesses different from each other.

12 Claims, 14 Drawing Sheets

SPEAKER

TECHNICAL FIELD

The present invention relates to a piezoelectric speaker using piezoelectric elements.

BACKGROUND ART

A piezoelectric speaker has a merit that the piezoelectric speaker is easily thinned, since the piezoelectric speaker does not require a magnetic circuit, which is a drive system, unlike an electrodynamic speaker. However, the piezoelectric speaker has a demerit that when the same voltage is applied, the amplitude of a diaphragm is small and the reproduction sound pressure is low as compared to the electrodynamic speaker. In addition, many existing piezoelectric speakers are fixed at their peripheries, and thus are used for reproduction of middle and high frequencies and have difficulties in performing reproduction of low frequencies.

Therefore, in order to increase the reproduction sound pressure to enable also reproduction of low frequencies, a method of connecting a plurality of piezoelectric diaphragms in a vibration direction is conceived of (e.g., see Patent Literature 1). FIG. 13 is a conventional piezoelectric speaker described in Patent Literature 1. FIG. 14 schematically shows a vibration mode of the conventional piezoelectric speaker.

In FIG. 13, the conventional piezoelectric speaker includes an upper piezoelectric diaphragm 1, a lower piezoelectric diaphragm 2, connecting members 3, an edge 4, an upper frame 5, and a lower frame 6. The upper piezoelectric diaphragm 1 is a diaphragm with a bimorph structure including a substrate 1*a* and piezoelectric elements 1*b* and 1*c*. Similarly, the lower piezoelectric diaphragm 2 is also a diaphragm with a bimorph structure including a substrate 2*a* and piezoelectric elements 2*b* and 2*c*.

End portions of the upper piezoelectric diaphragm 1 and the lower piezoelectric diaphragm 2 are connected to each other via the connecting members 3, and a central portion of the lower piezoelectric diaphragm 2 is adhered to the lower frame 6. In addition, the edge 4 is formed so as to cover tops of the upper piezoelectric diaphragm 1 and the upper frame 5. The edge 4 is provided to block sound emitted from the lower piezoelectric diaphragm 2 and the back side of the upper piezoelectric diaphragm 1. A stretchable laminate material is used for the edge 4. Furthermore, the polarities of the piezoelectric elements 1*b*, 1*c*, 2*b*, and 2*c* are set such that the upper piezoelectric diaphragm 1 and the lower piezoelectric diaphragm 2 are bended in opposite directions when a voltage is applied thereto.

In the conventional piezoelectric speaker, due to the above configuration, when a voltage is applied to the piezoelectric elements, the upper piezoelectric diaphragm 1 and the lower piezoelectric diaphragm 2 bend in directions opposite to each other. In other words, in the conventional piezoelectric speaker, a state where the upper piezoelectric diaphragm 1 and the lower piezoelectric diaphragm 2 become convex outwardly as shown in FIG. 14(*a*) and a state where the upper piezoelectric diaphragm 1 and the lower piezoelectric diaphragm 2 become convex inwardly as shown in FIG. 14(*b*) are alternately repeated. As a result, the amplitude of the upper piezoelectric diaphragm 1 is twice as large as that in the case of using a single piezoelectric diaphragm, and it is possible to increase the reproduction sound pressure. In addition, since the upper piezoelectric diaphragm 1 is supported by the edge 4 made of the laminate material, reproduction of low frequencies is enabled.

CITATION LIST

Patent Literature

[PTL 1] International Publication WO 2010/137242

SUMMARY OF THE INVENTION

Problems to be Solved by the Invention

With the above conventional configuration, the reproduction sound pressure is increased as compared to the case of using a single piezoelectric diaphragm, and it is possible to reproduce bass. However, the piezoelectric diaphragms greatly bend as the reproduction sound pressure is increased. Thus, when the reproduction sound pressure is increased, stress generated in each piezoelectric diaphragm may exceed the breaking stress of the piezoelectric elements, and the piezoelectric elements may be broken. In such a case, the speaker malfunctions. Thus, actually, the amplitude of each piezoelectric diaphragm is limited, and thus there is a problem that it is impossible to sufficiently increase the reproduction sound pressure.

The present invention solves the aforementioned problems of the conventional art and provides a piezoelectric speaker that allows for improvement of its reproduction sound pressure.

Solution to the Problems

In order to solve the aforementioned problems of the conventional art, a speaker according to an aspect of the present invention includes: a plurality of piezoelectric diaphragms each including a substrate and a piezoelectric element provided on at least one surface of the substrate; one or a plurality of connecting members connecting the plurality of piezoelectric diaphragms to each other such that the plurality of piezoelectric diaphragms are aligned from a piezoelectric diaphragm located at a frontmost side of the speaker, in a thickness direction of the piezoelectric diaphragm, and piezoelectric diaphragms adjacent to each other face each other at an interval; and a support member supporting a back-side diaphragm that is a piezoelectric diaphragm at a backmost side of the speaker. The plurality of piezoelectric diaphragms include two piezoelectric diaphragms having stiffnesses different from each other.

Advantageous Effects of the Invention

In the present invention, by causing the stiffnesses of the two piezoelectric diaphragms to be different from each other, it is possible to control the amplitude of each piezoelectric diaphragm at a time of voltage input and to reduce the maximum value of stress generated in each piezoelectric diaphragm. As a result, it is possible to provide a piezoelectric speaker that allows for improvement of its reproduction sound pressure.

DESCRIPTION OF EMBODIMENTS

Figure 1:
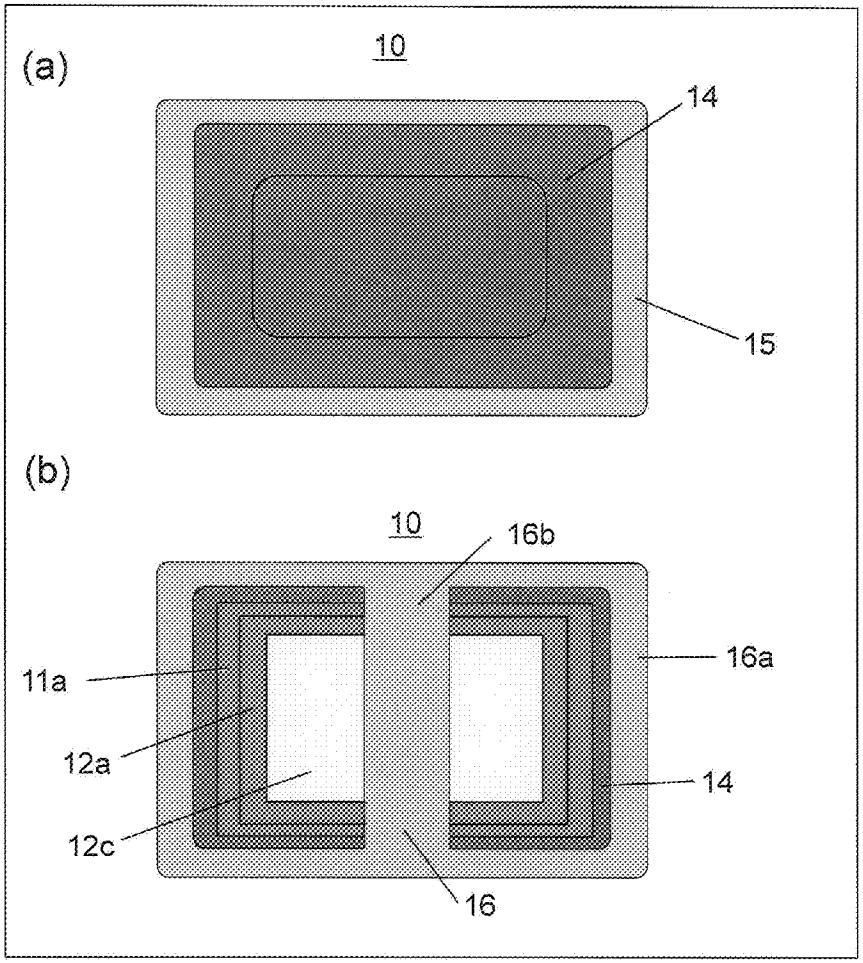
FIG. 1 is a front view and a rear view of a piezoelectric speaker according to Embodiment 1.

Hereinafter, embodiments of the present invention will be described with reference to the drawings.

A speaker according to a first aspect includes: a plurality of piezoelectric diaphragms each including a substrate and a piezoelectric element provided on at least one surface of the substrate; one or a plurality of connecting members connecting the plurality of piezoelectric diaphragms to each other such that the plurality of piezoelectric diaphragms are aligned from a piezoelectric diaphragm located at a frontmost side of the speaker, in a thickness direction of the piezoelectric diaphragm, and piezoelectric diaphragms adjacent to each other face each other at an interval; and a support member supporting a back-side diaphragm that is a piezoelectric diaphragm at a backmost side of the speaker. The plurality of piezoelectric diaphragms include two piezoelectric diaphragms having stiffnesses different from each other. With this configuration, for example, it is possible to control a vibration mode of each piezoelectric diaphragm at a time of large amplitude and to reduce stress generated in each piezoelectric element. As a result, it is possible to improve the maximum sound pressure at which reproduction is enabled. It should be noted that in this speaker, for example, the piezoelectric diaphragms adjacent to each other vibrate so as to be bended in directions opposite to each other when observed at the same timing.

In a speaker according to a second aspect based on the first aspect, the support member supports a central portion of the back-side diaphragm, and the back-side diaphragm has a stiffness higher than that of an adjacent piezoelectric diaphragm at a front side of the back-side diaphragm. With this configuration, it is possible to increase the amplitude of the front-side piezoelectric diaphragm, and thus it is possible to further improve the maximum sound pressure at which reproduction is enabled. In addition, it is possible to suppress an increase in stress that may be increased due to the central portion of the back-side diaphragm being fixed to the support member, by causing the stiffnesses of the piezoelectric diaphragms to be different from each other.

In a speaker according to a third aspect based on the second aspect, the substrate of the back-side diaphragm has a stiffness higher than that of the substrate of the adjacent piezoelectric diaphragm at the front side. With this configuration, it is possible to easily reduce stress at a time of large amplitude by causing the stiffnesses of the substrates to be different from each other without changing the configuration of the entirety of the speaker.

In a speaker according to a fourth aspect based on the first aspect, the support member supports end portions of the back-side diaphragm at positions opposed to each other, respectively, the connecting member connects a central portion of the back-side diaphragm to a central portion of an adjacent piezoelectric diaphragm at a front side of the back-side diaphragm, and the back-side diaphragm has a stiffness lower than that of the adjacent piezoelectric diaphragm at the front side. With this configuration, it is possible to suppress an increase in stress that may be increased due to the central portions of the piezoelectric diaphragms being connected to each other, by causing the stiffnesses of the piezoelectric diaphragms to be different from each other.

In a speaker according to a fifth aspect based on the fourth aspect, the substrate of the back-side diaphragm has a stiffness lower than that of the substrate of the adjacent piezoelectric diaphragm at the front side. With this configuration, it is possible to easily reduce stress at a time of large amplitude by causing the stiffnesses of the substrates to be different from each other without changing the configuration of the entirety of the speaker.

In a speaker according to a sixth aspect based on any one of the first to fifth aspects, of the two piezoelectric diaphragms, a piezoelectric diaphragm having a higher maximum value of bending stress applied thereto during vibration has a stiffness higher than that of the other piezoelectric diaphragm. With this configuration, it is possible to suppress stress on the piezoelectric diaphragm having a higher maximum value of bending stress applied thereto during vibration, by causing the stiffnesses of the piezoelectric diaphragms to be different from each other.

In a speaker according to a seventh aspect based on any one of the first to sixth aspects, the stiffnesses of the two piezoelectric diaphragms are made different from each other by causing thicknesses of the substrates thereof to be different from each other. With this configuration, it is possible to easily reduce stress at a time of large amplitude by causing the thicknesses of the substrates to be different from each other without changing the configuration of the entirety of the speaker.

In a speaker according to an eighth aspect based on any one of the first to seventh aspects, the stiffnesses of the two piezoelectric diaphragms are made different from each other by using materials different from each other for the substrates thereof. For example, for the substrate of the piezoelectric diaphragm having a higher stiffness, a material having an elastic modulus higher than that of the other piezoelectric diaphragm is used. With this configuration, for example, it is possible to cause the stiffnesses of the piezoelectric diaphragms to be different from each other on the basis of only the materials of the substrates, and it is possible to easily reduce stress at a time of large amplitude. Furthermore, by using a material having high internal loss, it is possible to suppress a quality factor Q in terms of sound pressure frequency characteristics and to improve flatness.

In a speaker according to a ninth aspect based on any one of the first to eighth aspects, the stiffnesses of the two piezoelectric diaphragms are made different from each other by causing thicknesses of the piezoelectric elements thereof to be different from each other. With this configuration, for example, it is possible to cause the stiffnesses of the piezoelectric diaphragms to be different from each other on the basis of the thicknesses of the piezoelectric elements, and it is possible to easily reduce stress at a time of large amplitude.

(Embodiment 1)

A piezoelectric speaker according to Embodiment 1 of the present invention includes two piezoelectric diaphragms having stiffnesses different from each other, a connecting member which connects the two piezoelectric diaphragms to each other, and a frame which supports a central portion of the piezoelectric diaphragm that is located at a lower side when the sound radiation surface side of the piezoelectric speaker is defined as an upper side. Of the two piezoelectric diaphragms, the diaphragm having a higher stiffness is used as a piezoelectric diaphragm having a higher maximum value of bending stress applied thereto at a time of amplitude. Thus, by controlling a vibration mode of each piezoelectric diaphragm at a time of large amplitude, it is possible to reduce the maximum value of stress, and it is possible to improve the maximum sound pressure at which reproduction is enabled.

Figure 2:
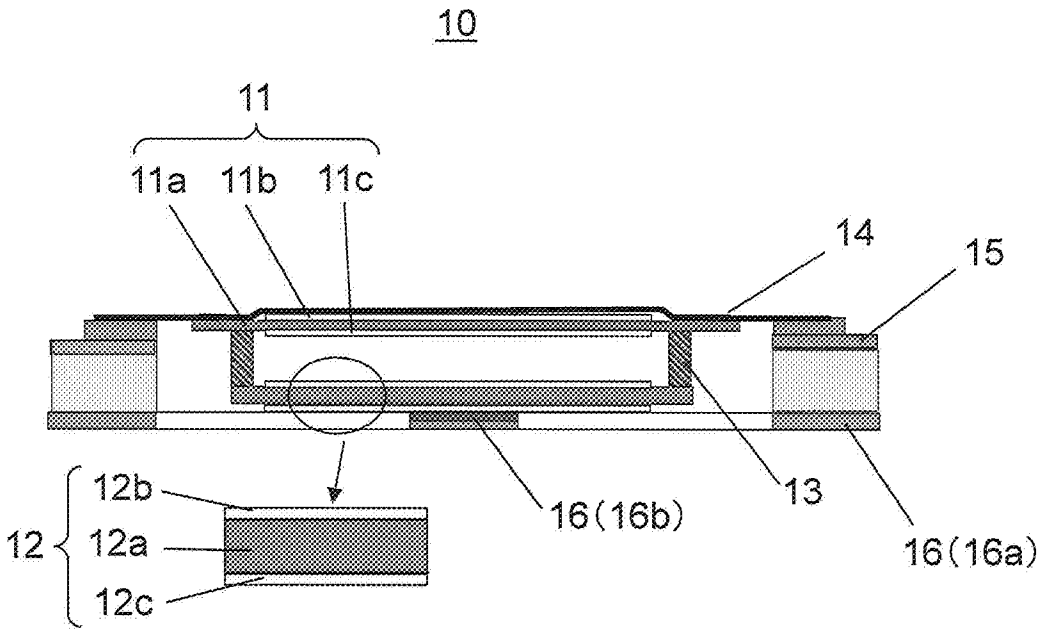
FIG. 2 is a cross-sectional view of the piezoelectric speaker according to Embodiment 1.

FIG. 1 is a front view (FIG. 1(*a*)) and a rear view (FIG. 1(*b*)) of a piezoelectric speaker 10 according to Embodiment 1. FIG. 2 is a cross-sectional view of the piezoelectric speaker 10 according to Embodiment 1. In the piezoelectric speaker 10, the sound radiation surface side is defined as a front side (an upper side in FIG. 2), and a side reverse to the sound radiation surface side is defined as a back side (a lower side in FIG. 2).

As shown in FIGS. 1 and 2, the piezoelectric speaker 10 includes an upper piezoelectric diaphragm 11 (a front-side diaphragm), a lower piezoelectric diaphragm 12 (a back-side diaphragm), connecting members 13, an edge 14, an upper frame 15, and a lower frame 16 (a support member).

As shown in FIG. 2, the upper piezoelectric diaphragm 11 is a substantially-rectangular diaphragm with a bimorph structure including a substrate 11*a* (a substrate) and two piezoelectric elements 11*b* and 11*c*. Each of the substrate 11*a* and the piezoelectric elements 11*b* and 11*c* is formed in a plate shape or a sheet shape. The lower piezoelectric diaphragm 12 is a substantially-rectangular diaphragm with a bimorph structure including a substrate 12*a* (a substrate) and two piezoelectric elements 12*b* and 12*c*. Each of the substrate 12*a* and the piezoelectric elements 12*b* and 12*c* is formed in a plate shape or a sheet shape. The thicknesses of the four piezoelectric elements 11*b*, 11*c*, 12*b*, and 12*c* used in the upper piezoelectric diaphragm 11 and the lower piezoelectric diaphragm 12 are the same. It should be noted that the shape of each of the piezoelectric diaphragms 11 and 12 is not limited to the substantially rectangular shape, and may be, for example, a circular shape.

It should be noted that a material having insulating properties such as a general-purpose plastic material (polycarbonate, a polyalylate film, polyethylene terephthalate, or polyimide, etc.) or a liquid crystal polymer can be used for the substrate 11*a* and the substrate 12*a*. In addition, each of the piezoelectric elements 11*b*, 11*c*, 12*b*, and 12*c* can have a structure in which, for example, a plate-shaped piezoelectric member is sandwiched between electrodes (the illustration thereof is omitted). A single-crystal piezoelectric material, a ceramic piezoelectric material, and a high-molecular piezoelectric material, or the like can be used for the piezoelectric member which expands and contracts in response to the electrodes to which a voltage is applied. The stiffness of each of the piezoelectric elements 11*b*, 11*c*, 12*b*, and 12*c* is higher than the stiffness of each of the substrate 11*a* and the substrate 12*a*.

In the upper piezoelectric diaphragm 11, the piezoelectric elements 11*b* and 11*c* are bonded to both surfaces of the substrate 11*a*, respectively. For example, both surfaces of the substrate 11*a* except for the outer peripheral side of the substrate 11*a* are covered with the piezoelectric elements 11*b* and 11*c*. In the lower piezoelectric diaphragm 12, the piezoelectric elements 12*b* and 12*c* are bonded to both surfaces of the substrate 12*a*, respectively. For example, both surfaces of the substrate 12*a* except for the outer peripheral side of the substrate 12*a* are covered with the piezoelectric elements 12*b* and 12*c*.

As shown in FIG. 2, the upper piezoelectric diaphragm 11 and the lower piezoelectric diaphragm 12 are provided so as to face each other at an interval. The polarization directions of the front-side piezoelectric element 11*b* of the upper piezoelectric diaphragm 11 and the back-side piezoelectric element 12*c* of the lower piezoelectric diaphragm 12 are the same, and the polarization directions of the back-side piezoelectric element 11*c* of the upper piezoelectric diaphragm 11 and the front-side piezoelectric element 12*b* of the lower piezoelectric diaphragm 12 are the same. By so polarizing, the upper piezoelectric diaphragm 11 and the lower piezoelectric diaphragm 12 bend in opposite directions with regard to a main sound radiation direction (a vibration direction of the piezoelectric diaphragms 11 and 12), when a voltage is applied thereto. It should be noted that the bending directions of the piezoelectric diaphragms 11 and 12 may be controlled on the basis of a way of applying a voltage, not on the basis of the polarization directions of the piezoelectric elements 11*b*, 11*c*, 12*b*, and 12*c*.

The upper piezoelectric diaphragm 11 and the lower piezoelectric diaphragm 12 will be compared with each other. In a planar view, the substrate 11*a* of the upper piezoelectric diaphragm 11 is slightly larger in size than the substrate 12*a* of the lower piezoelectric diaphragm 12 as shown in FIG. 1(*b*). The thickness of the substrate 11*a* is smaller than the thickness of the substrate 12*a*. In addition, the four piezoelectric elements 11*b*, 11*c*, 12*b*, and 12*c* used in the upper piezoelectric diaphragm 11 and the lower piezoelectric diaphragm 12 are the same in size in a planar view, and are also the same in thickness. The four piezoelectric elements 11*b*, 11*c*, 12*b*, and 12*c* are the same. Since the stiffness of the substrate 12*a* is higher than the stiffness of the substrate 11*a* and the stiffnesses of the four piezoelectric elements 11*b*, 11*c*, 12*b*, and 12*c* are the same, the stiffness of a main region of the lower piezoelectric diaphragm 12 (a region where the piezoelectric elements 12*b* and 12*c* are laminated on the substrate 12*a*) is higher than the stiffness of a main region of the upper piezoelectric diaphragm 11 (a region where the piezoelectric elements 11*b* and 11*c* are laminated on the substrate 11*a*).

The upper piezoelectric diaphragm 11 and the lower piezoelectric diaphragm 12 are connected at both corner portions, in the longitudinal direction, of the substrate 11*a* and the substrate 12*a* to each other via the connecting members 13.

The connecting members 13 are provided such that the upper piezoelectric diaphragm 11 and the lower piezoelectric diaphragm 12 are spaced apart from each other in the vibration direction of the piezoelectric elements. The connecting members 13 connect the upper piezoelectric diaphragm 11 to the lower piezoelectric diaphragm 12 such that the outer peripheries of the four piezoelectric elements 11*b*, 11*c*, 12*b*, and 12*c* overlap each other when the piezoelectric speaker 10 is viewed in perspective from the front. The connecting members 13 are provided at both corner portions, in the longitudinal direction, of the substrate 11*a* and the substrate 12*a*. However, both end portions, in the longitudinal direction, of the substrate 11*a* and the substrate 12*a* may be connected to each other via two connecting members 13 (e.g., bar-shaped members). Various materials can be used for the connecting members 13. For example, a member formed from an ABS (acrylonitrile-butadiene-styrene) resin or the like can be used.

The edge 14 is a substantially-rectangular sheet-shaped member which is elastically deformable. The stiffness of the edge 14 is very low as compared to the upper frame 15 and the lower frame 16. As shown in FIGS. 1 and 2, the edge 14 is provided so as to cover tops of the upper piezoelectric diaphragm 11 and the upper frame 15. An outer peripheral portion of the edge 14 is fixed to the upper frame 15. In FIG. 1, the edge 14 fully covers the front surface of the upper piezoelectric diaphragm 11 and closes the entirety of the gap between the outer peripheral surface of the upper piezoelectric diaphragm 11 and the inner peripheral surface of the frame 15. The edge 14 is provided in order to vibratably support the upper piezoelectric diaphragm 11 and in order to block sound emitted from the back side of the upper piezoelectric diaphragm 11 and sound emitted from the lower piezoelectric diaphragm 12. The material of the edge 14 is, for example, SBR (styrene-butadiene rubber).

The upper frame 15 is formed in a substantially rectangular frame shape. As shown in FIG. 2, the lower frame 16 includes a main body 16*a* having a substantially rectangular frame shape, and a band-shaped support portion 16*b* which traverses the inside of the frame of the main body 16*a*. The support portion 16*b* extends in the short side direction of the lower frame 16. The lower piezoelectric diaphragm 12 is adhered at a central portion thereof to the support portion 16*b* of the lower frame 16. The central portion of the lower piezoelectric diaphragm 12 is fixed to the support portion 16*b* such that the central portion is not moved during vibration, and movement of the central portion is restrained. The lower frame 16 is connected to a lower portion of the upper frame 15. The upper frame 15 and the lower frame 16 are integrated with each other.

Figure 14:
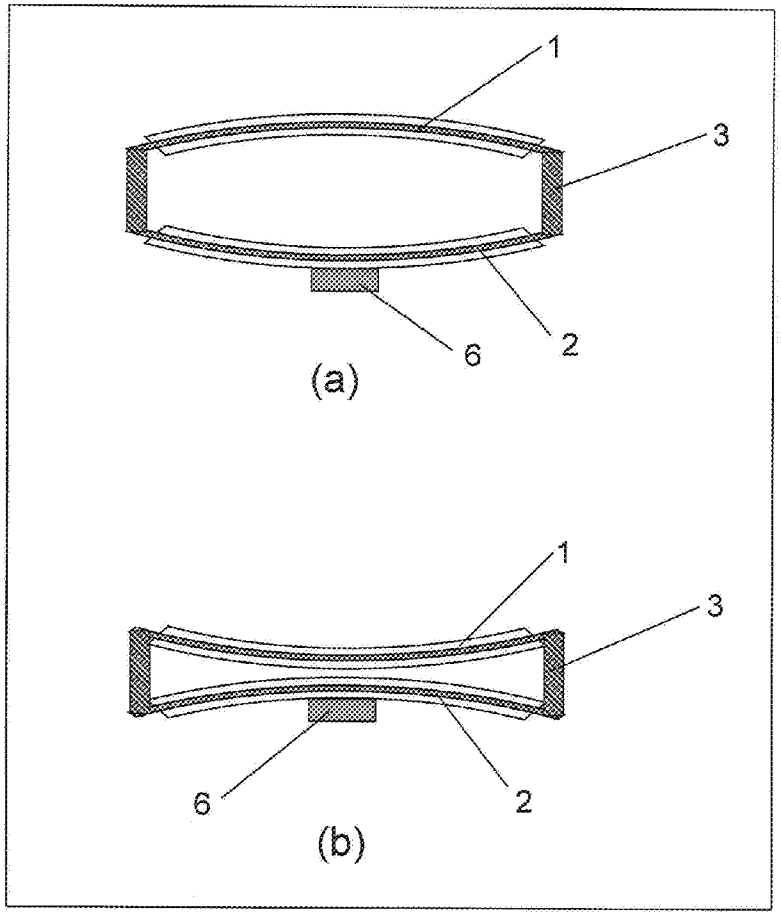
FIG. 14(*a*) is a diagram showing a vibration mode of the conventional piezoelectric speaker, and FIG. 14(*b*) is a diagram showing the vibration mode of the conventional piezoelectric speaker.

Hereinafter, an operation of the piezoelectric speaker 10 according to Embodiment 1 will be described. A method of driving the upper piezoelectric diaphragm 11 and the lower piezoelectric diaphragm 12 by applying a drive voltage to surface electrodes (not shown) of the piezoelectric elements 11*b*, 11*c*, 12*b*, and 12*c* is the same as that for a conventional piezoelectric speaker. When the drive voltage is applied, the upper piezoelectric diaphragm 11 and the lower piezoelectric diaphragm 12 vibrate so as to bend in directions opposite to each other as shown in FIGS. 14(*a*) and 14(*b*). As a result, sound is emitted from the upper piezoelectric diaphragm 11.

Here, the difference from the conventional piezoelectric speaker is that the thickness of the substrate 11*a* of the upper piezoelectric diaphragm 11 and the thickness of the substrate 12*a* of the lower piezoelectric diaphragm 12 are different from each other. In Embodiment 1, the thickness of the substrate 12*a* of the lower piezoelectric diaphragm 12 adhered to the hard frame 16 is larger than that of the substrate 11*a* of the upper piezoelectric diaphragm 11 supported by the flexible edge 14.

Figure 3:
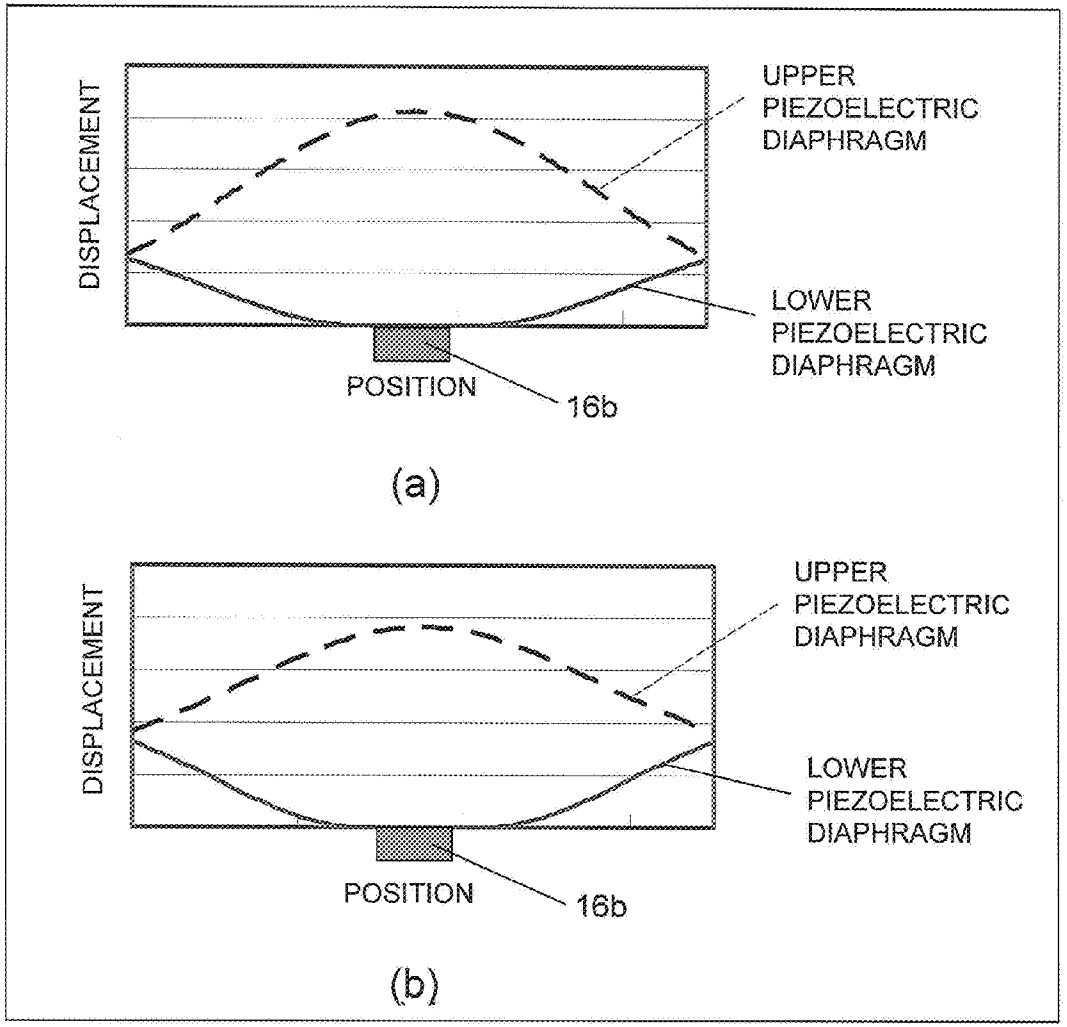
FIG. 3(*a*) is a diagram showing a vibration mode of the piezoelectric speaker according to Embodiment 1, and FIG. 3(*b*) is a diagram showing a vibration mode of a conventional piezoelectric speaker.

FIG. 3(*a*) is a diagram showing a vibration mode of the piezoelectric speaker 10 configured as described above. FIG. 3(*b*) is a diagram showing a vibration mode of a conventional piezoelectric speaker in which the thicknesses of the substrate 11*a* and the substrate 12*a* are the same. In comparison between FIG. 3(*a*) and FIG. 3(*b*), a state is the same in which the upper piezoelectric diaphragm and the lower piezoelectric diaphragm bend in directions opposite to each other. Whereas the amplitude of the upper piezoelectric diaphragm and the amplitude of the lower piezoelectric diaphragm are substantially the same in the conventional piezoelectric speaker, the amplitude of the upper piezoelectric diaphragm 11 is larger than the amplitude of the lower piezoelectric diaphragm 12 in the piezoelectric speaker 10 according to Embodiment 1. This is because the thicknesses of the substrate 11*a* and the substrate 12*a* are made different from each other. When the substrate 12*a* is thickened, the stiffness of the lower piezoelectric diaphragm 12 is increased. As a result, the lower piezoelectric diaphragm 12 is less likely to bend, and the amplitude of the upper piezoelectric diaphragm 11 becomes larger than that of the lower piezoelectric diaphragm 12 when a voltage is applied thereto.

Figure 4:
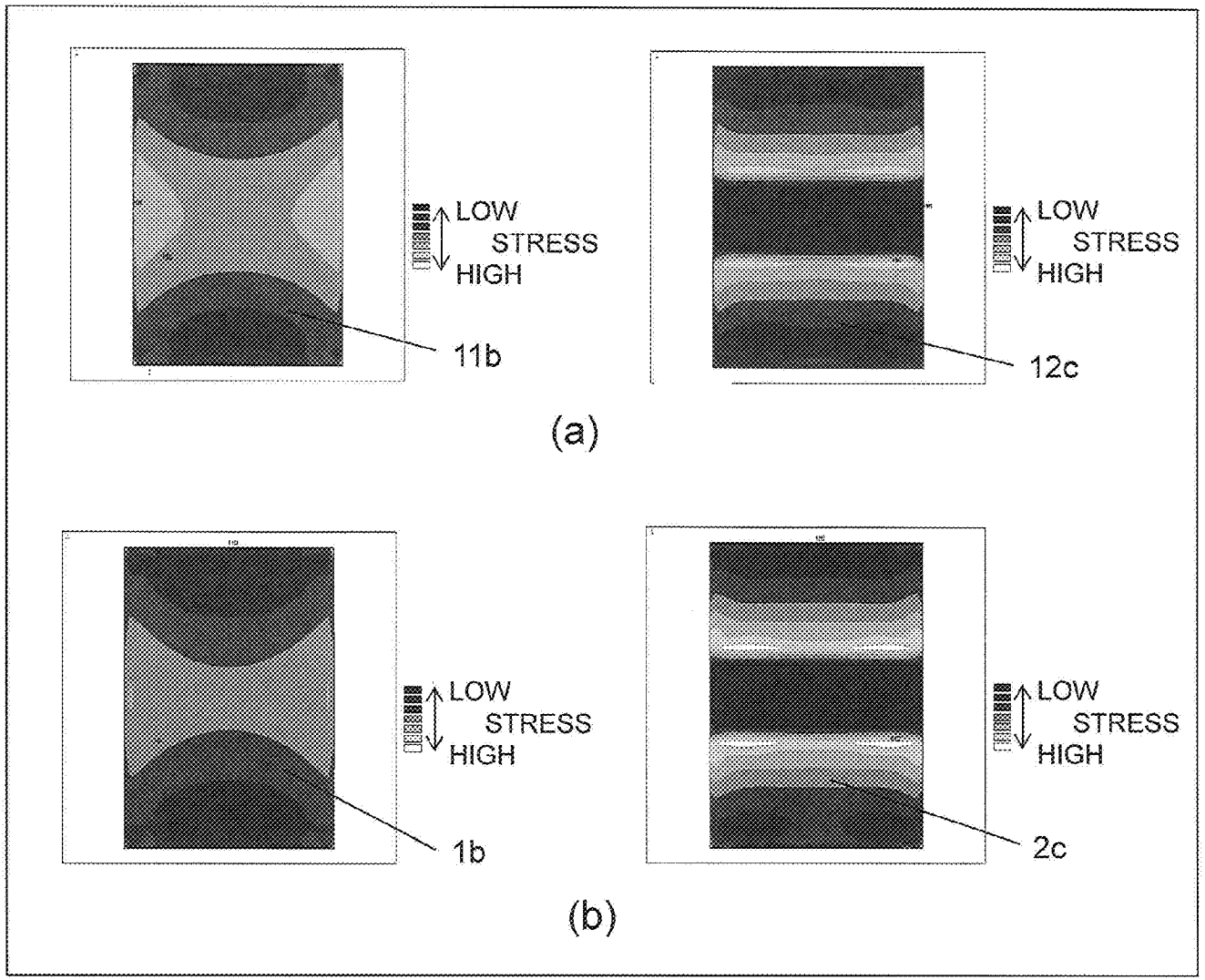
FIG. 4(*a*) is a diagram showing stress distributions generated in piezoelectric elements of the piezoelectric speaker according to Embodiment 1, and FIG. 4(*b*) is a diagram showing stress distributions generated in piezoelectric elements of the conventional piezoelectric speaker.

FIG. 4 shows stress distributions generated in the piezoelectric elements during deformation of the upper piezoelectric diaphragm and the lower piezoelectric diaphragm. FIG. 4(*a*) shows stress distributions generated in the respective piezoelectric elements 11*b* and 12*c* of the piezoelectric speaker 10 according to Embodiment 1, and FIG. 4(*b*) shows stress distributions generated in respective piezoelectric elements 1*b* and 2*c* of the conventional piezoelectric speaker. As a result of comparison between them, in the piezoelectric speaker 10 according to Embodiment 1, the maximum stress value at a time of amplitude is decreased due to the difference between the thicknesses of the substrates 11*a* and 12*a*. Stress on the piezoelectric element 12*c* of the lower piezoelectric diaphragm 12, which stress is high in the conventional piezoelectric speaker, is reduced by increasing the thickness of the substrate 12*a* to reduce the amplitude of the lower piezoelectric diaphragm 12. On the other hand, stress on the piezoelectric element 11*b* of the upper piezoelectric diaphragm 11, which stress is low in the conventional piezoelectric speaker, is increased by decreasing the thickness of the substrate 11*a* to increase the amplitude of the upper piezoelectric diaphragm 11. In other words, stress which is concentrated on the piezoelectric element 12*c* of the lower piezoelectric diaphragm 12 is distributed to the piezoelectric elements 11*b* and 11*c* of the upper piezoelectric diaphragm 11 and the piezoelectric elements 12*b* and 12*c* of the lower piezoelectric diaphragm 12, resulting in a reduction in the maximum stress on the piezoelectric speaker 10. Due to the reduced maximum stress at a time of amplitude, it is made possible to cause the upper piezoelectric diaphragm 11 to vibrate at a larger amplitude, and it is possible to improve the maximum sound pressure.

Figure 5:
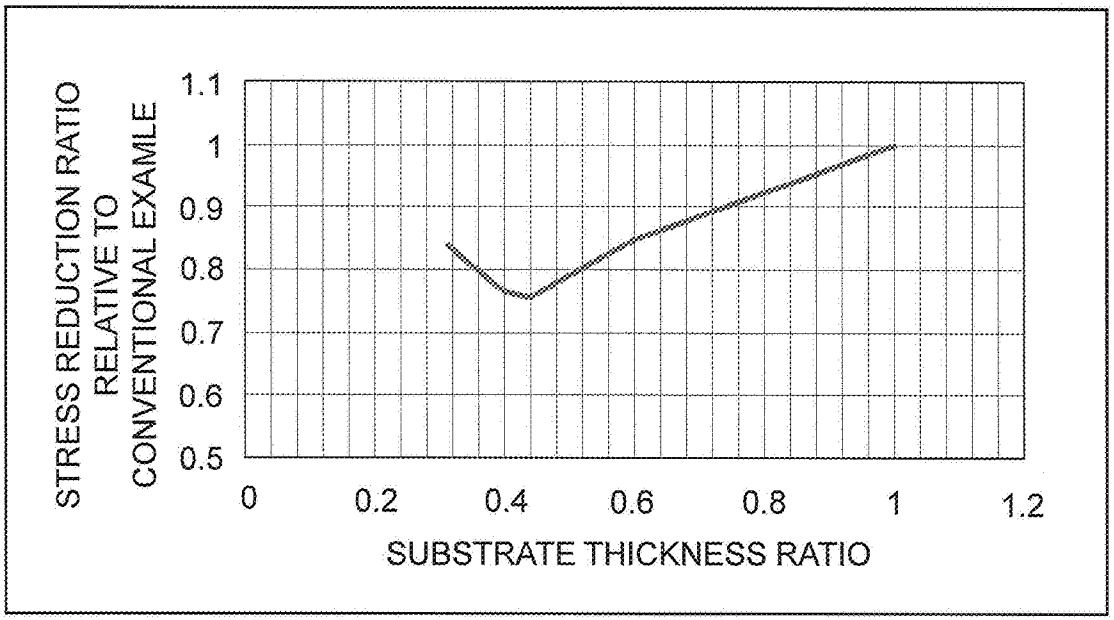
FIG. 5 is a diagram showing a relationship between a substrate thickness ratio and a stress reduction ratio relative to a conventional example in Embodiment 1.

FIG. 5 is a graph showing a relationship between a substrate thickness ratio, which is a ratio between the thicknesses of the two substrates 11*a* and 12*a*, and a stress reduction ratio (a reduction ratio of the maximum stress value relative to the conventional piezoelectric speaker). The horizontal axis indicates the substrate thickness ratio (thickness of substrate 11*a* of upper piezoelectric diaphragm 11/thickness of substrate 12*a* of lower piezoelectric diaphragm 12). The vertical axis indicates a value obtained by dividing a maximum stress value in the case of each substrate thickness ratio by a maximum stress value in the case where the substrate thickness ratio is 1, that is, a stress reduction effect when the substrate thickness ratio is changed. From FIG. 5, when the substrate thickness ratio is near 0.5, the maximum stress value is reduced by about 25%, and it is possible to improve the maximum sound pressure by about 2.5 dB. Here, from FIG. 5, it is recognized that the stress reduction ratio is inversely increased when the substrate thickness ratio falls below a definite value. This is because the maximum stress applied to the piezoelectric element 11*b* of the upper piezoelectric diaphragm 11 becomes higher than the maximum stress applied to the piezoelectric element 12*c* of the lower piezoelectric diaphragm 12. In other words, when such a substrate thickness ratio is adopted that the stress reduction ratio is lowest (i.e., the maximum stress applied to the piezoelectric element 11*b* of the upper piezoelectric diaphragm 11 is substantially equal to the maximum stress applied to the piezoelectric element 12*c* of the lower piezoelectric diaphragm 12), a preferred structure that improves the maximum sound pressure is provided.

In addition, in the above description, in order to cause the stiffnesses of the upper piezoelectric diaphragm 11 and the lower piezoelectric diaphragm 12 to be different from each other, the thicknesses of the substrate 11*a* and the substrate 12*a* are made different from each other. However, Embodiment 1 is not limited thereto. By using different materials for the substrate 11*a* and the substrate 12*a*, the stiffnesses of the substrate 11*a* and the substrate 12*a* may be made different from each other, whereby the stiffnesses of the upper piezoelectric diaphragm 11 and the lower piezoelectric diaphragm 12 are made different from each other. In this case, the elastic modulus of the substrate 11*a* of the upper piezoelectric diaphragm 11 is made lower than that of the substrate 12*a* of the lower piezoelectric diaphragm 12. For example, polyether imide (used for the substrate 12*a*) and polyethylene terephthalate (used for the substrate 11*a*) having different elastic moduli can be used. In this case as well, the same effect of reducing the maximum stress is obtained. It should be noted that in this case, the thicknesses of the substrate 11*a* and the substrate 12*a* may be the same, or the substrate 12*a* may be thicker than the substrate 11*a*.

Furthermore, in the above description, the thicknesses of the respective piezoelectric elements 11*b*, 11*c*, 12*b*, and 12*c* are the same, but may be different from each other. In other words, when the thicknesses of the piezoelectric elements 12*b* and 12*c* are made larger than the thicknesses of the piezoelectric elements 11*b* and 11*c*, it is also possible to obtain the same advantageous effect. In addition, the sizes or the shapes of the piezoelectric elements 11*b* and 11*c* may be made different from those of the piezoelectric elements 12*b* and 12*c*, whereby the same advantageous effect is obtained. Moreover, the drive voltage applied to the piezoelectric elements 11*b* and 11*c* and the drive voltage applied to the piezoelectric elements 12*b* and 12*c* may be made different from each other, whereby the same advantageous effect is obtained.

Moreover, in the above description, the edge 14 is provided so as to cover the tops of the upper piezoelectric diaphragm 11 and the upper frame 15. However, Embodiment 1 is not limited thereto. The edge 14 may be provided only over the gap between the upper piezoelectric diaphragm 11 and the upper frame 15 so as to close the gap. Furthermore, the edge 14 is formed in a flat shape. However, Embodiment 1 is not limited thereto. The portion of the edge 14 over the gap between the upper piezoelectric diaphragm 11 and the upper frame 15 may be formed in a roll shape (e.g., a shape bent so as to bulge outwardly). By so forming in the roll shape, linearity of the amplitude relative to an input voltage is increased, and it is possible to realize reproduction with low distortion. In this case, an elastomer material may be molded and used.

Furthermore, the upper piezoelectric diaphragm 11 and the lower piezoelectric diaphragm 12 employ the bimorph structure. However, Embodiment 1 is not limited thereto. The upper piezoelectric diaphragm 11 and the lower piezoelectric diaphragm 12 may employ a monomorph (unimorph) structure. In other words, the upper piezoelectric diaphragm 11 may be composed of the substrate 11*a* and the piezoelectric element 11*b*, and the lower piezoelectric diaphragm 12 may be composed of the substrate 12*a* and the piezoelectric element 12*b*.

(Embodiment 2)

A piezoelectric speaker 20 according to Embodiment 2 includes two piezoelectric diaphragms having stiffnesses different from each other, a connecting member which connects the two piezoelectric diaphragm to each other, and a frame which supports an end portion of the piezoelectric diaphragm that is located at a lower side (a back side). Of the two piezoelectric diaphragms, the diaphragm having a higher stiffness is used as a piezoelectric diaphragm having a higher maximum value of bending stress applied thereto at a time of amplitude. Thus, by controlling a vibration mode of each piezoelectric diaphragm at a time of large amplitude, it is possible to reduce the maximum value of stress, and it is possible to improve the maximum sound pressure at which reproduction is enabled.

Figure 6:
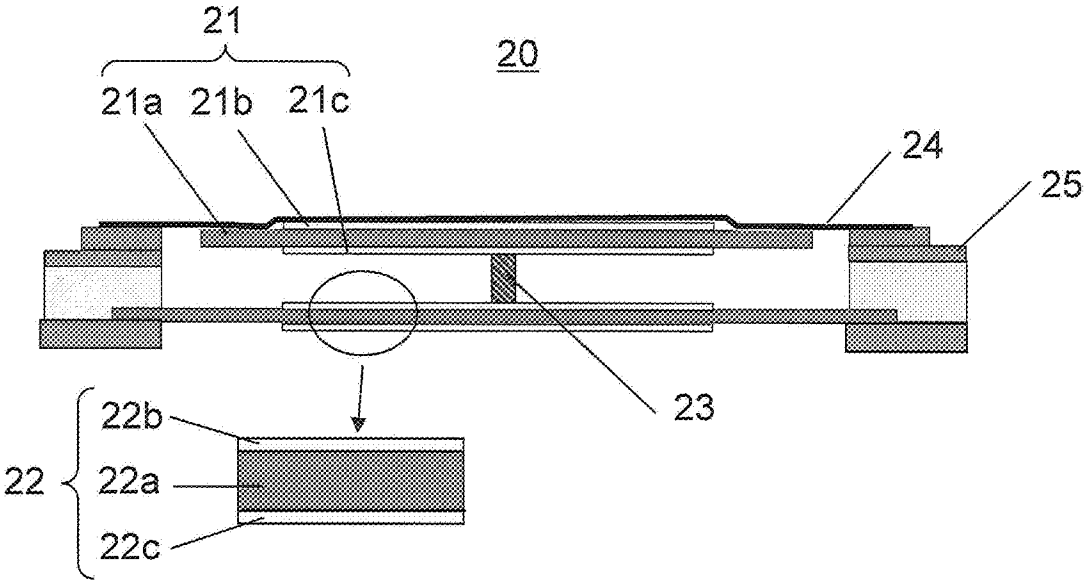
FIG. 6 is a cross-sectional view of a piezoelectric speaker according to Embodiment 2.

FIG. 6 is a cross-sectional view of the piezoelectric speaker 20 according to Embodiment 2.

As shown in FIG. 6, the piezoelectric speaker 20 includes an upper piezoelectric diaphragm 21 (a front-side diaphragm), a lower piezoelectric diaphragm 22 (a back-side diaphragm), a connecting member 23, an edge 24, and a frame 25 (a support member). Each of the piezoelectric diaphragms 21 and 22 has, for example, a substantially rectangular shape.

The configuration of the upper piezoelectric diaphragm 21 is the same as that in Embodiment 1, and includes a substrate 21*a* (a substrate) and two piezoelectric elements 21*b* and 21*c*. Similarly, the lower piezoelectric diaphragm 22 includes a substrate 22*a* (a substrate) and two piezoelectric elements 22*b* and 22*c*. The thicknesses of the four piezoelectric elements 21*b*, 21*c*, 22*b*, and 22*c* are the same also in Embodiment 2.

In addition, similarly to Embodiment 1, the polarization directions of the piezoelectric elements 21*b*, 21*c*, 22*b*, and 22*c* are also set such that the upper piezoelectric diaphragm 21 and the lower piezoelectric diaphragm 22 bend in opposite directions with regard to a main sound radiation direction, when a voltage is applied thereto.

Furthermore, similarly, the edge 24 is provided so as to cover tops of the upper piezoelectric diaphragm 21 and the frame 25. An outer peripheral portion of the edge 24 is fixed to the frame 25.

The difference from Embodiment 1 is a position at which the upper piezoelectric diaphragm 21 and the lower piezoelectric diaphragm 22 are connected to each other via the connecting member 23, a position at which the frame 25 supports the lower piezoelectric diaphragm 22, and a relationship between the thicknesses of the substrate 21*a* of the upper piezoelectric diaphragm 21 and the substrate 22*a* of the lower piezoelectric diaphragm 22. As shown in FIG. 6, the upper piezoelectric diaphragm 21 and the lower piezoelectric diaphragm 22 are connected at central portions thereof to each other via the connecting member 23. The lower piezoelectric diaphragm 22 is supported at both end portions, in the longitudinal direction, of the substrate 22*a* by the frame 25. In addition, the substrate 21*a* of the upper piezoelectric diaphragm 21 supported by the edge 24 is thicker than the substrate 22*a* of the lower piezoelectric diaphragm 22 supported by the frame 25.

It should be noted that a method of driving the upper piezoelectric diaphragm 21 and the lower piezoelectric diaphragm 22 by applying a drive voltage to surface electrodes (not shown) of the piezoelectric elements 21*b*, 21*c*, 22*b*, and 22*c* is the same as those for the conventional piezoelectric speaker and Embodiment 1.

Figure 7:
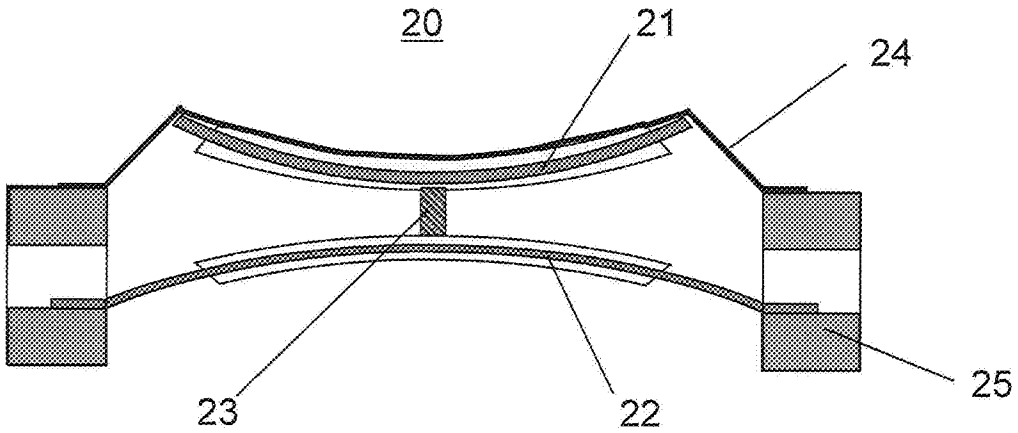
FIG. 7 is a diagram showing a vibration mode of the piezoelectric speaker according to Embodiment 2.

FIG. 7 shows a vibration mode of the piezoelectric speaker 20 according to Embodiment 2. The upper piezoelectric diaphragm 21 and the lower piezoelectric diaphragm 22 vibrate so as to bend in directions opposite to each other. As a result, sound is emitted from the upper piezoelectric diaphragm 21. The position at which the piezoelectric diaphragms 21 and 22 are connected to each other via the connecting member 23 and the position at which the frame 25 supports the substrate 22*a* are different from those in Embodiment 1. Thus, the vibration mode is different from that in Embodiment 1.

By causing the thicknesses of the substrate 21*a* and the substrate 22*a* to be different from each other, the amplitudes of the upper piezoelectric diaphragm 21 and the lower piezoelectric diaphragm 22 are controlled, the maximum stress generated in the piezoelectric elements 21*b*, 21*c*, 22*b*, and 22*c* is reduced, and the maximum sound pressure is improved, which is the same as in Embodiment 1. In the structure in Embodiment 2, the thickness of the substrate 21*a* of the upper piezoelectric diaphragm 21 is increased, since stress generated in the piezoelectric elements 21*b* and 21*c* of the upper piezoelectric diaphragm 21 is higher than that in the piezoelectric elements 22*b* and 22*c* of the lower piezoelectric diaphragm 22 if the substrate thicknesses of the upper piezoelectric diaphragm 21 and the lower piezoelectric diaphragm 22 are the same.

In addition, in the above description, in order to cause the stiffnesses of the upper piezoelectric diaphragm 21 and the lower piezoelectric diaphragm 22 to be different from each other, the thicknesses of the substrate 21*a* and the substrate 22*a* are made different from each other. However, Embodiment 2 is not limited thereto. By using different materials for the substrate 21*a* and the substrate 22*a*, the stiffnesses of the substrate 21*a* and the substrate 22*a* may be made different from each other, whereby the stiffnesses of the upper piezoelectric diaphragm 21 and the lower piezoelectric diaphragm 22 are made different from each other. In this case, the elastic modulus of the substrate 21*a* of the upper piezoelectric diaphragm 21 is made higher than that of the substrate 22*a* of the lower piezoelectric diaphragm 22.

Furthermore, in the above description, the thicknesses of the respective piezoelectric elements 21*b*, 21*c*, 22*b*, and 22*c* are the same, but may be different from each other. In other words, by causing the thicknesses of the piezoelectric elements 21*b* and 21*c* to be larger than the thicknesses of the piezoelectric elements 22*b* and 22*c*, it is also possible to obtain the same advantageous effect. Alternatively, the sizes or the shapes of the piezoelectric elements 21*b* and 21*c* may be made different from those of the piezoelectric elements 22*b* and 22*c*, whereby the same advantageous effect is obtained. Alternatively, the drive voltage applied to the piezoelectric elements 21*b* and 21*c* and the drive voltage applied to the piezoelectric elements 22*b* and 22*c* may be made different from each other, whereby the same advantageous effect is obtained.

Moreover, in the above description, the edge 24 is provided so as to cover the tops of the upper piezoelectric diaphragm 21 and the frame 25. However, Embodiment 2 is not limited thereto. The edge 24 may be provided only over the gap between the upper piezoelectric diaphragm 21 and the upper frame 25 so as to close the gap. Furthermore, the edge 24 is formed in a flat shape, but the shape of the portion of the edge 24 over the gap between the upper piezoelectric diaphragm 21 and the frame 25 may be a roll shape. With the roll shape, linearity of the amplitude relative to an input voltage is increased, and it is possible to realize reproduction with low distortion.

Other than the above, all the modifications described in Embodiment 1 are applicable to the piezoelectric speaker 20 according to Embodiment 2.

(Embodiment 3)

Figure 8A:
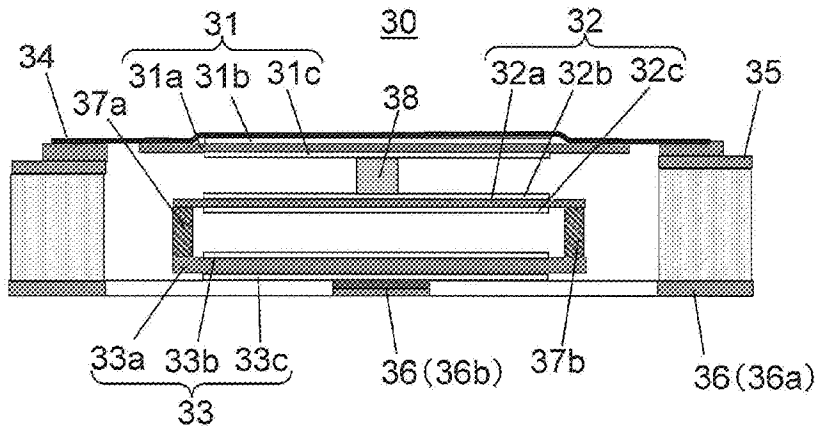
FIG. 8A is a cross-sectional view of a piezoelectric speaker according to Embodiment 3.
Figure 8B:
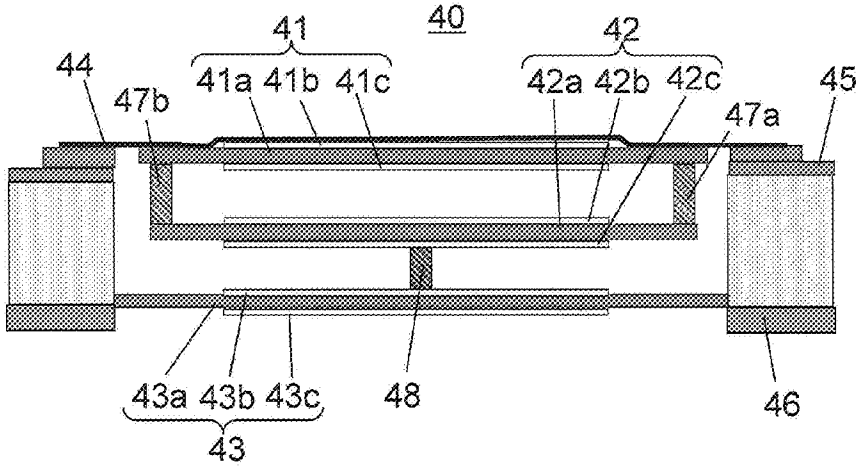
FIG. 8B is a cross-sectional view of a piezoelectric speaker, of a mode different from FIG. 8A, according to Embodiment 3.

Piezoelectric speakers 30 and 40 according to Embodiment 3 are different from the aforementioned embodiments in that three piezoelectric diaphragms are provided. FIG. 8A is a cross-sectional view of the piezoelectric speaker 30 according to Embodiment 3. FIG. 8B is the piezoelectric speaker 40, of a mode different from FIG. 8A, according to Embodiment 3.

As shown in FIG. 8A, the piezoelectric speaker 30 includes three piezoelectric diaphragms 31, 32, and 33, a plurality of connecting members 37*a*, 37*b*, and 38, an edge 34, an upper frame 35, and a lower frame 36. Each of the piezoelectric diaphragms 31, 32, and 33 is a diaphragm with a bimorph structure. In the respective piezoelectric diaphragms 31, 32, and 33, piezoelectric elements 31*b*, 31*c*, 32*b*, 32*c*, 33*b*, and 33*c* are bonded to both surfaces of respective substrates 31*a*, 32*a*, and 33*a*. It should be noted that in order from the front side of the speaker 30, the piezoelectric diaphragms 31, 32, and 33 are referred to as first piezoelectric diaphragm 31, second piezoelectric diaphragm 32, and third piezoelectric diaphragm 33. Each of the piezoelectric diaphragms 31, 32, and 33 has, for example, a rectangular shape.

The connecting member 33 connects a central portion of the first piezoelectric diaphragm 31 and a central portion of the second piezoelectric diaphragm 32 to each other. The respective connecting members 37*a* and 37*b* connect the second piezoelectric diaphragm 32 and the third piezoelectric diaphragm 33 to each other at both corner portions thereof in the longitudinal direction. The edge 34 is provided so as to cover tops of the first piezoelectric diaphragm 31 and the upper frame 35. The lower frame 36 includes a frame-shaped main body 36*a* and a band-shaped support portion 36*b* which traverses the inside of the frame of the main body 36*a*. The central portion of the third piezoelectric diaphragm 33 (a back-side diaphragm) is adhered to the support portion 36*b*. The three piezoelectric diaphragms 31, 32, and 33 vibrate such that the piezoelectric diaphragms adjacent to each other bend in directions opposite to each other.

The stiffness of the third piezoelectric diaphragm 33 is higher than the stiffness of the second piezoelectric diaphragm 32. In Embodiment 3, by causing the thickness of the substrate 33*a* to be larger than that of the substrate 32*a*, the stiffness of the substrate 33*a* is made higher than that of the substrate 32*a*. However, similarly to Embodiment 1 and Embodiment 2 described above, the stiffness of the second piezoelectric diaphragm 32 and the stiffness of the third piezoelectric diaphragm 33 may be made different from each other by using different materials for the substrate 32*a* and 33*a* or causing the stiffnesses of the piezoelectric elements 32*b*, 32*c*, 33*b*, and 33*c* to be different from each other. It should be noted that the stiffness of the first piezoelectric diaphragm 31 and the stiffness of the second piezoelectric diaphragm 32 may be the same, or the stiffness of the first piezoelectric diaphragm 31 may be higher than that of the second piezoelectric diaphragm 32.

Meanwhile, the speaker 40 shown in FIG. 8B is different from FIG. 8A in connecting members 47 and 48 and a lower frame 46. The connecting member 48 connects a central portion of a second piezoelectric diaphragm 42 and a central portion of a third piezoelectric diaphragm 43 to each other. The respective connecting members 47*a* and 47*b* connect a first piezoelectric diaphragm 41 and the second piezoelectric diaphragm 42 to each other at both corner portions thereof in the longitudinal direction. The lower frame 46 supports both end portions, in the longitudinal direction, of a substrate 43*a*. In FIG. 8B, the stiffness of the third piezoelectric diaphragm 43 is lower than the stiffness of the second piezoelectric diaphragm 42. It should be noted that the stiffness of the first piezoelectric diaphragm 41 and the stiffness of the second piezoelectric diaphragm 42 may be the same, or the stiffness of the first piezoelectric diaphragm 41 may be higher than that of the second piezoelectric diaphragm 42.

(Embodiment 4)

Figure 9A:
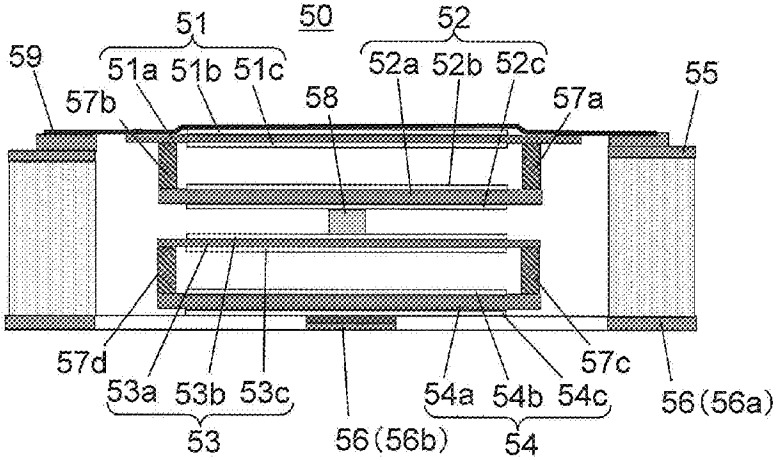
FIG. 9A is a cross-sectional view of a piezoelectric speaker according to Embodiment 4.
Figure 9B:
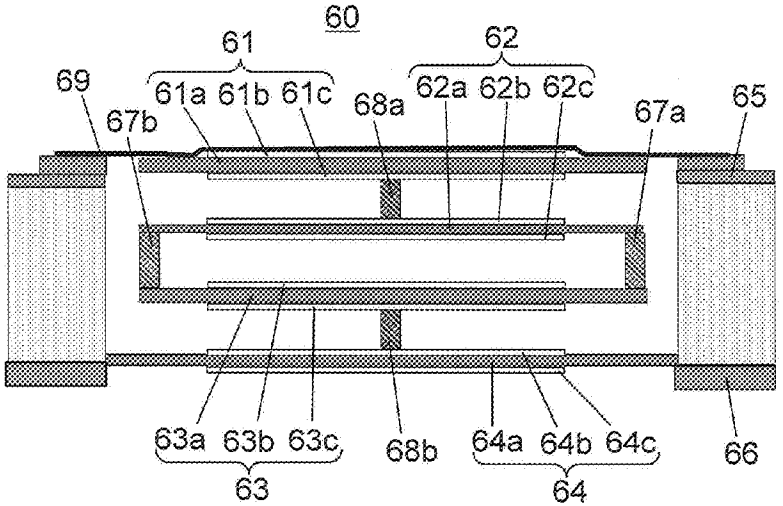
FIG. 9B is a cross-sectional view of a piezoelectric speaker, of a mode different from FIG. 9A, according to Embodiment 4.

Piezoelectric speakers 50 and 60 according to Embodiment 4 are different from the aforementioned embodiments in that four piezoelectric diaphragms are provided. FIG. 9A is a cross-sectional view of the piezoelectric speaker 50 according to Embodiment 4. FIG. 9B is a cross-sectional view of the piezoelectric speaker 60, of a mode different from FIG. 9A, according to Embodiment 4.

As shown in FIG. 9A, the piezoelectric speaker 50 includes four piezoelectric diaphragms 51, 52, 53, and 54, a plurality of connecting members 57*a* to 57*b* and 58, an edge 59, an upper frame 55, and a lower frame 56. Each of the piezoelectric diaphragms 51, 52, 53, and 54 is a diaphragm with a bimorph structure. In the respective piezoelectric diaphragms 51, 52, 53, and 54, piezoelectric elements 51*b*, 51*c*, 52*b*, 52*c*, 53*b*, 53*c*, 54*b*, and 54*c* are bonded to both surfaces of respective substrates 51*a*, 52*a*, 53*a*, and 54*a*. It should be noted that in order from the front side of the speaker 50, the piezoelectric diaphragms 51, 52, 53, and 54 are referred to as first piezoelectric diaphragm 51, second piezoelectric diaphragm 52, third piezoelectric diaphragm 53, and fourth piezoelectric diaphragm 54. Each of the piezoelectric diaphragms 51, 52, 53, and 54 has, for example, a rectangular shape.

The connecting member 58 connects a central portion of the second piezoelectric diaphragm 52 and a central portion of the third piezoelectric diaphragm 53 to each other. The respective connecting members 57*a* and 57*b* connect the first piezoelectric diaphragm 51 and the second piezoelectric diaphragm 52 to each other at both corner portions thereof in the longitudinal direction. The respective connecting members 57*c* and 57*d* connect the third piezoelectric diaphragm 53 and the fourth piezoelectric diaphragm 54 to each other at both corner portions thereof in the longitudinal direction. The edge 59 is provided so as to cover tops of the first piezoelectric diaphragm 51 and the upper frame 55. The lower frame 56 includes a frame-shaped main body 56*a* and a band-shaped support portion 56*b* which traverses the inside of the frame of the main body 56*a*. A central portion of the fourth piezoelectric diaphragm 54 (a back-side diaphragm) is adhered to the support portion 56*b*. The four piezoelectric diaphragms 51, 52, 53, and 54 vibrate such that the piezoelectric diaphragms adjacent to each other bend in directions opposite to each other.

The stiffness of the fourth piezoelectric diaphragm 54 is higher than the stiffness of the third piezoelectric diaphragm 53. In addition, the stiffness of the second piezoelectric diaphragm 52 is higher than the stiffness of the first piezoelectric diaphragm 51. In Embodiment 4, of two piezoelectric diaphragms adjacent to each other, the thickness of the substrate of the piezoelectric diaphragm whose stiffness is made higher is made larger than the thickness of the substrate of the other piezoelectric diaphragm, whereby stiffnesses in a main region are made different from each other. However, similarly to Embodiments 1 to 3 described above, the stiffnesses of the two piezoelectric diaphragms adjacent to each other may be made different from each other by using different materials for the substrates or causing the stiffnesses of the piezoelectric elements to be different from each other. It should be noted that the stiffness of the first piezoelectric diaphragm 51 and the stiffness of the third piezoelectric diaphragm 53 may be the same or may be different from each other.

Meanwhile, the speaker 60 shown in FIG. 9B is different from FIG. 9A in connecting members 67 and 68 and a lower frame 66. The connecting member 68*a* connects a central portion of a first piezoelectric diaphragm 61 and a central portion of a second piezoelectric diaphragm 62 to each other. The connecting member 68*b* connects a central portion of a third piezoelectric diaphragm 63 and a central portion of a fourth piezoelectric diaphragm 64 to each other. The respective connecting members 67*a* and 67*b* connect the second piezoelectric diaphragm 62 and the third piezoelectric diaphragm 63 to each other at both corner portions thereof in the longitudinal direction. The lower frame 66 supports both end portions, in the longitudinal direction, of a substrate 64*a*. In FIG. 9B, the stiffness of the fourth piezoelectric diaphragm 64 is lower than the stiffness of the third piezoelectric diaphragm 63. In addition, the stiffness of the second piezoelectric diaphragm 62 is lower than the stiffness of the first piezoelectric diaphragm 61. It should be noted that the stiffness of the fourth piezoelectric diaphragm 64 and the stiffness of the second piezoelectric diaphragm 62 may be the same, or the stiffness of the fourth piezoelectric diaphragm 64 may be higher than that of the second piezoelectric diaphragm 62.

(Embodiment 5)

Figure 10:
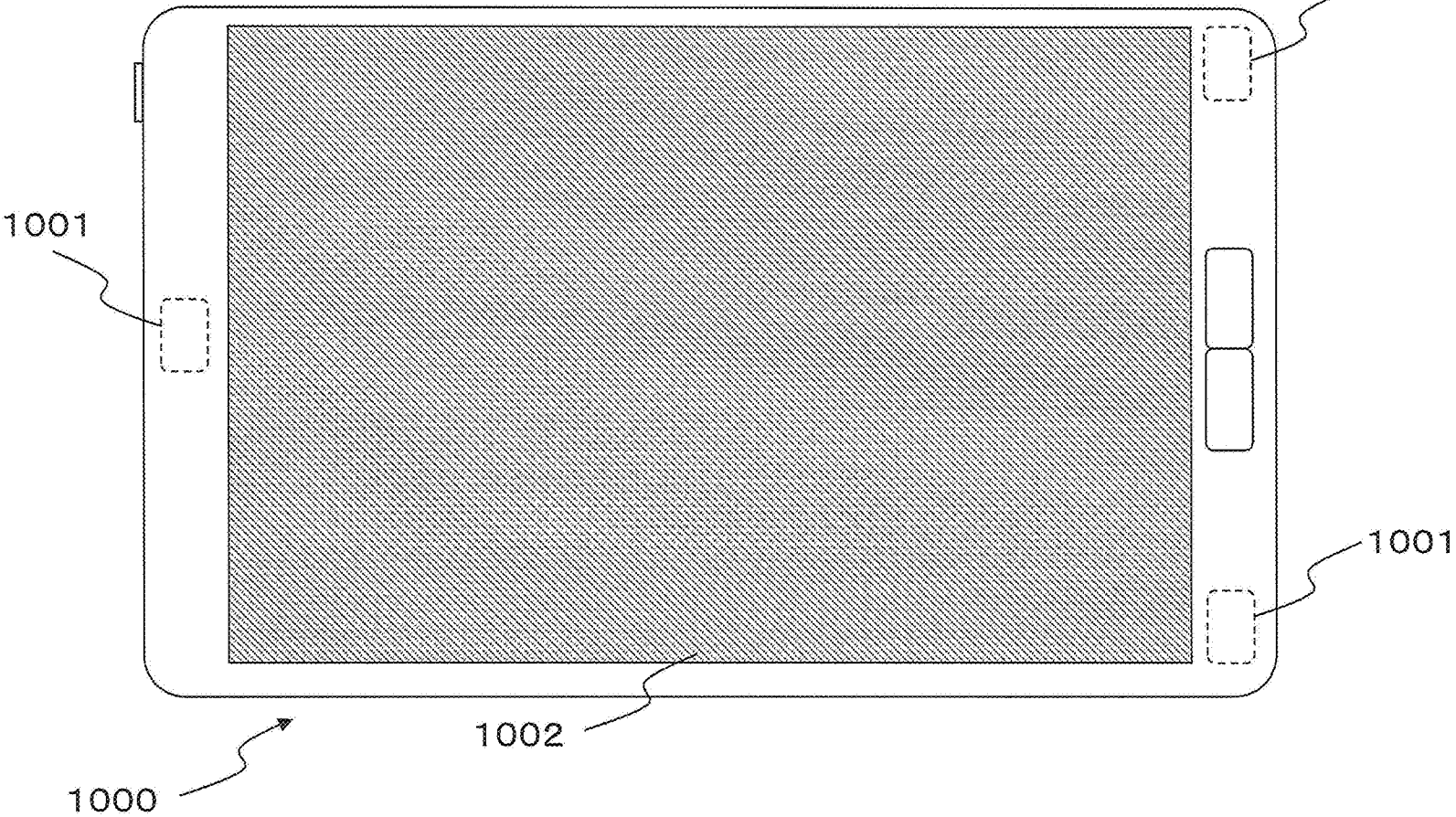
FIG. 10 is a front view of a mobile information terminal apparatus according to Embodiment 5.

FIG. 10 is a mobile information terminal apparatus according to Embodiment 5 which employs the piezoelectric speaker described above. In FIG. 10, reference character 1000 denotes the mobile information terminal apparatus, reference character 1002 denotes a screen, and reference character 1001 denotes a speaker device selected from the piezoelectric speakers according to Embodiments 1 to 4. It should be noted that the speaker device 1001, together with a closed type cabinet or a bass-reflex type cabinet, may be mounted to the mobile information terminal apparatus 1000. Alternatively, the speaker device 1001 may be mounted as an open type to the mobile information terminal apparatus 1000 without a cabinet. In FIG. 10, the speaker device 1001 is disposed at three locations, but the number of the speaker devices 1001 may be any number as long as the number is one or more. With a single speaker device 1001, the apparatus becomes monophonic; with two speaker devices 1001, the apparatus becomes stereophonic; and with two or more speaker devices 1001, the apparatus can be used for acoustic field control or for HRTF.

Even with an apparatus having a limited volume for mounting such as the mobile information terminal apparatus, when the speaker device 1001 is mounted to the mobile information terminal apparatus, reproduction is stably enabled in a wide frequency range.

(Embodiment 6)

Figure 11:
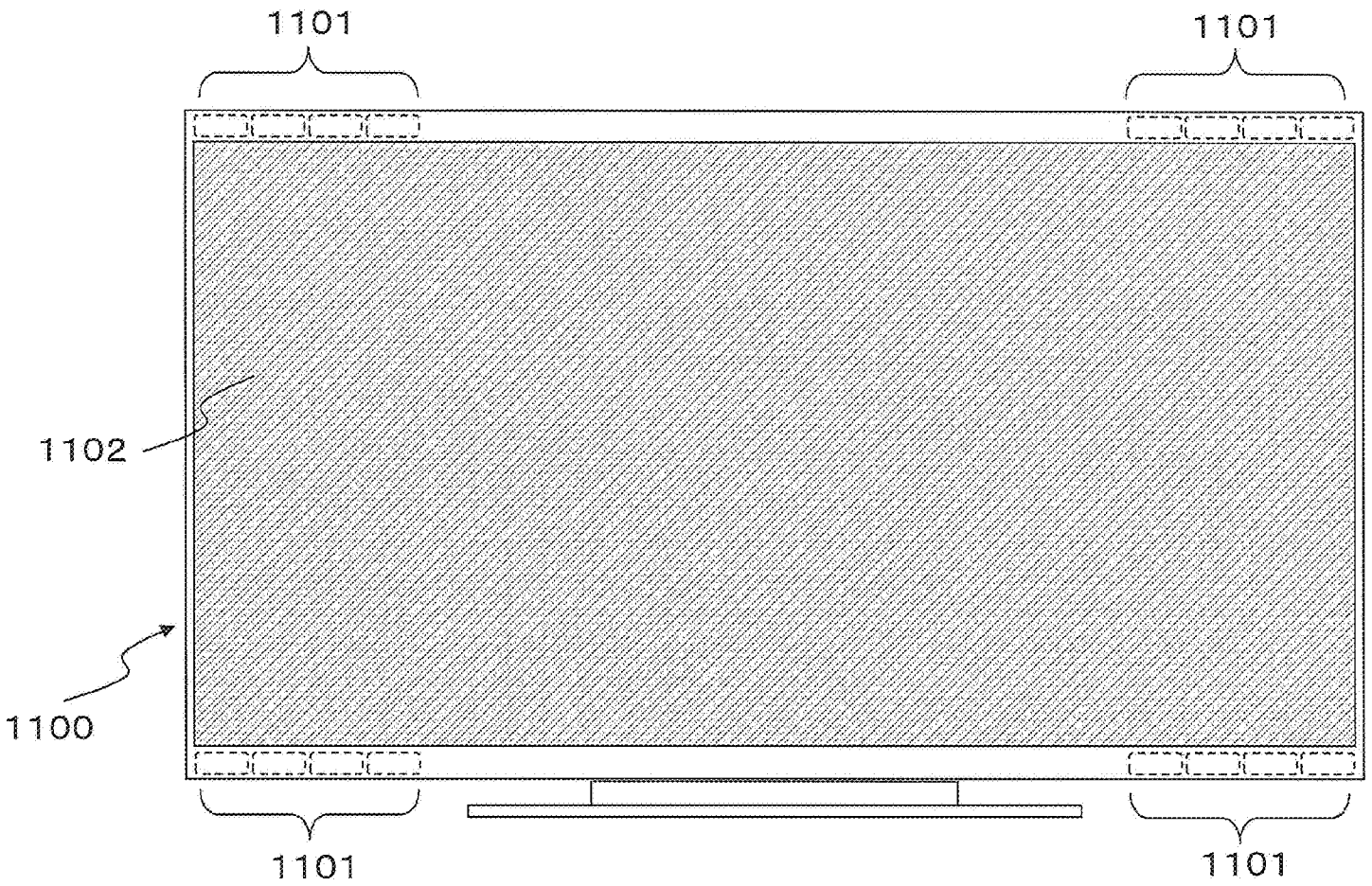
FIG. 11 is a front view of an image display apparatus according to Embodiment 6.

FIG. 11 is an image display apparatus according to Embodiment 6 which employs the piezoelectric speaker described above. Specifically, the image display apparatus is a PC or a thin type TV, etc. In FIG. 11, reference character 1100 denotes the image display apparatus, reference character 1102 denotes a screen, and reference character 1101 denotes a speaker device selected from the piezoelectric speakers according to Embodiments 1 to 4. It should be noted that the speaker device 1101, together with a closed type cabinet or a bass-reflex type cabinet, may be mounted to the image display apparatus 1100. Alternatively, the speaker device 1101 may be mounted as an open type to the image display apparatus 1100 without a cabinet. In FIG. 11, the speaker device 1101 is disposed at 16 locations in total, but the number of the speaker devices 1101 may be any number as long as the number is one or more. With a single speaker device 1101, the apparatus becomes monophonic; with two speaker devices 1101, the apparatus becomes stereophonic; and with two or more speaker devices 1101 (e.g., arranged in a line array), the apparatus can be used for acoustic field control or for HRTF.

Even with an apparatus having a limited volume for mounting such as the mobile information terminal apparatus, when the speaker device 1101 is mounted to the image display apparatus, reproduction is stably enabled in a wide frequency range.

(Embodiment 7)

Figure 12:
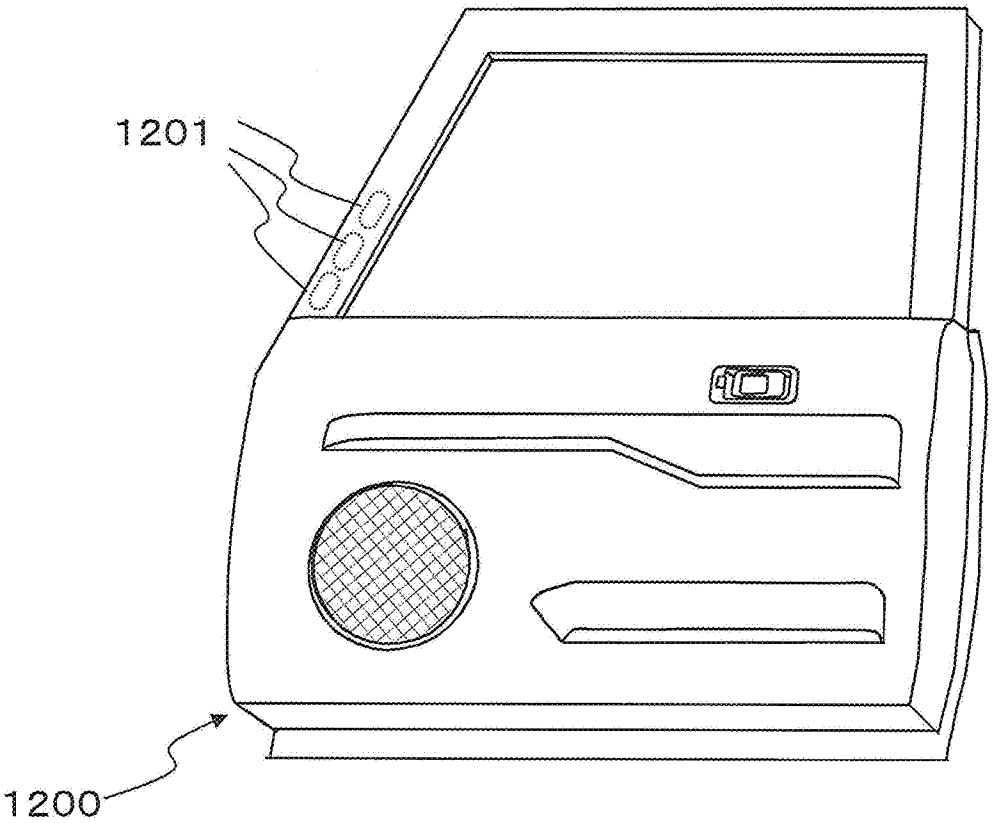
FIG. 12 is a diagram of a mounted state of an in-vehicle speaker according to Embodiment 7.
Figure 13:
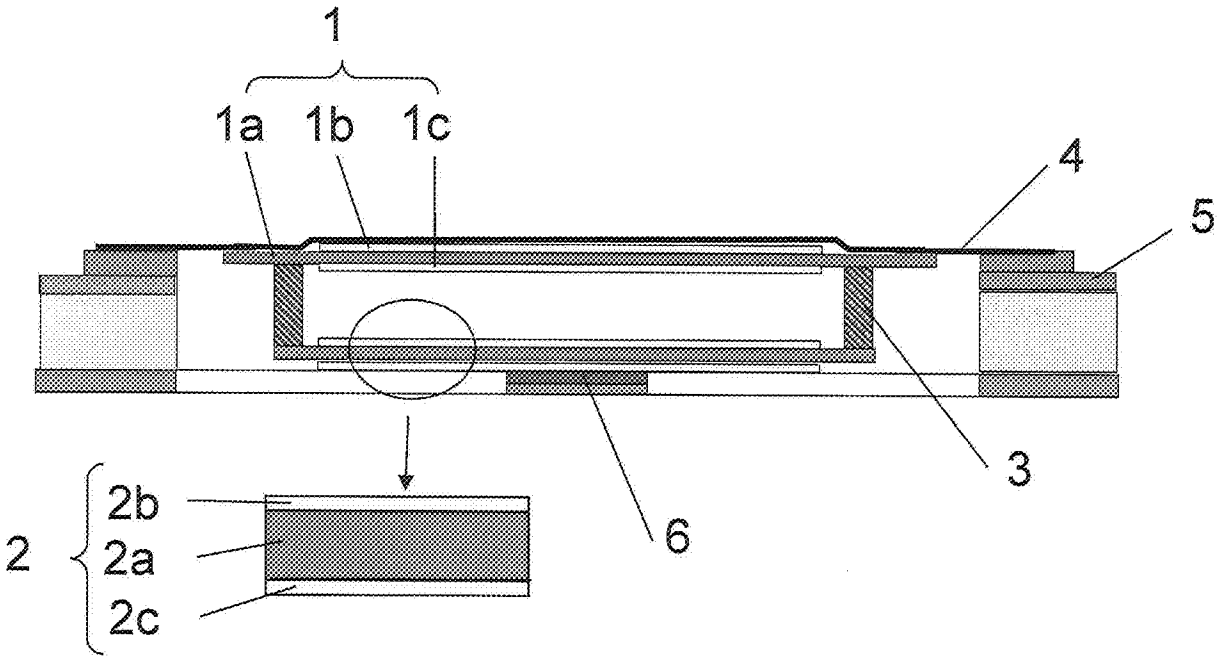
FIG. 13 is a cross-sectional view of a conventional piezoelectric speaker.

FIG. 12 is a diagram of a mounted state of a speaker device (an in-vehicle speaker) according to Embodiment 7. In FIG. 12, reference character 1200 denotes a door of an automobile, and reference character 1201 denotes a speaker device selected from the piezoelectric speakers according to Embodiments 1 to 4. It should be noted that the speaker device 1201, together with a closed type cabinet or a bass-reflex type cabinet, may be mounted to the door 1200. Alternatively, the speaker device 1201 may be mounted as an open type to the door 1200 without a cabinet. In FIG. 12, the speaker device 1201 is disposed at three locations, but the number of the speaker devices 1201 may be any number as long as the number of the speaker devices 1201 is one or more. In addition, FIG. 12 illustrates the example where the speaker device 1201 is mounted to the door 1200 of the automobile, but the speaker device 1201 may be mounted to a location other than a door, such as a dashboard, a pillar, a sheet, a headrest, and a ceiling of an automobile. Moreover, the piezoelectric speakers 10 and 20 may be mounted to various vehicles other than an automobile, such as a train, a monorail vehicle, a linear motor car, an airplane, and a ship.

Hitherto, a large-size speaker has been required to realize reproduction in a wide frequency range, particularly, reproduction of bass. With the piezoelectric speaker according to each embodiment using the piezoelectric elements, it is possible to realize the same acoustic characteristics as those of a conventional one, even when the piezoelectric speaker is reduced in size or weight as compared to the conventional one. This leads to size reduction or weight reduction of the entirety of a vehicle, and improvement of comfort due to an enlarged interior space and improvement of fuel consumption due to size reduction or weight reduction of the vehicle body are possible.

INDUSTRIAL APPLICABILITY

The piezoelectric speaker according to the present invention reduces stress generated in the piezoelectric elements due to the combination of the piezoelectric diaphragms having stiffnesses different from each other, and is able to improve the maximum sound pressure. The present invention is useful for a speaker for a thin type television, a speaker for a mobile phone, a speaker for a home theater, and a speaker for a vehicle, etc.

DESCRIPTION OF THE REFERENCE CHARACTERS

11 upper piezoelectric diaphragm
11*a* substrate
11*b* piezoelectric element
11*c* piezoelectric element
12 lower piezoelectric diaphragm
12*a* substrate
12*b* piezoelectric element
12*c* piezoelectric element
14 edge
15 upper frame
16 lower frame

The invention claimed is:

1. A speaker comprising:

a plurality of piezoelectric diaphragms each including a substrate and a piezoelectric element provided on at least one surface of the substrate, each of the piezoelectric diaphragms having end portions opposite to each other;

one or a plurality of connecting members connecting the plurality of piezoelectric diaphragms to each other at the end portions of each of the piezoelectric diaphragms, such that the plurality of piezoelectric diaphragms are aligned from a front-side piezoelectric diaphragm of the piezoelectric diaphragms located at a front-most side of the speaker, in a thickness direction of the front-side piezoelectric diaphragm, and adjacent pairs of the piezoelectric diaphragms face each other at an interval; and a support member supporting a back-side piezoelectric diaphragm of the piezoelectric diaphragms that is at a back-most side of the speaker, wherein the support member is fixed to a central portion of the back-side piezoelectric diaphragm, and the back-side piezoelectric diaphragm has a stiffness that is higher than that of an adjacent one of the piezoelectric diaphragms located toward the front-most side of the speaker.

2. The speaker according to claim 1, wherein the substrate of the back-side piezoelectric diaphragm has a stiffness that is higher than that of the substrate of the adjacent piezoelectric diaphragm located toward the front-most side of the speaker.

3. A speaker comprising:

a plurality of piezoelectric diaphragms each including a substrate and a piezoelectric element provided on at least one surface of the substrate;

one or a plurality of connecting members connecting the plurality of piezoelectric diaphragms to each other such that the plurality of piezoelectric diaphragms are aligned from a front-side piezoelectric diaphragm of the piezoelectric diaphragms located at a front-most side of the speaker, in a thickness direction of the front-side piezoelectric diaphragm, and adjacent pairs of the piezoelectric diaphragms face each other at an interval; and a support member supporting a back-side piezoelectric diaphragm of the piezoelectric diaphragms that is at a back-most side of the speaker, wherein the support member supports end portions of the back-side piezoelectric diaphragm at positions opposed to each other, respectively, the connecting member connects a central portion of the back-side piezoelectric diaphragm to a central portion of an adjacent one of the piezoelectric diaphragms located toward the front-most side of the speaker, and the back-side piezoelectric diaphragm has a stiffness that is lower than that of the adjacent piezoelectric diaphragm located toward the front-most side of the speaker.

4. The speaker according to claim 3, wherein the substrate of the back-side piezoelectric diaphragm has a stiffness that is lower than that of the substrate of the adjacent piezoelectric diaphragm located toward the front-most side of the speaker.

5. The speaker according to claim 1, wherein, one of the piezoelectric diaphragms having a higher maximum value of bending stress applied thereto during vibration has a stiffness higher than that of another of the piezoelectric diaphragms.

6. The speaker according to claim 1, wherein stiffnesses of at least two of the piezoelectric diaphragms are different from each other due to thicknesses of the substrates thereof being different from each other.

7. The speaker according to claim 1, wherein stiffnesses of at least two of the piezoelectric diaphragms are different from each other due to the substrates thereof comprising different materials.

8. The speaker according to claim 1, wherein stiffnesses of at least two of the piezoelectric diaphragms are different from each other due to thicknesses of the piezoelectric elements thereof being different from each other.

9. The speaker according to claim 1, further comprising:

a frame surrounding the front-side piezoelectric diaphragm; and an edge closing an entirety of a gap between an outer peripheral surface of the front-side piezoelectric diaphragm and an inner peripheral surface of the frame.

10. The speaker according to claim 3, further comprising:

a frame surrounding the front-side piezoelectric diaphragm; and an edge closing an entirety of a gap between an outer peripheral surface of the front-side piezoelectric diaphragm and an inner peripheral surface of the frame.

11. The speaker according to claim 1, wherein a region of the back-side piezoelectric diaphragm where the piezoelectric element is laminated on the substrate has a stiffness that is higher than that of a region of the adjacent piezoelectric diaphragm located toward the front-most side of the speaker where the piezoelectric element is laminated on the substrate.

12. The speaker according to claim 3, wherein a region of the back-side piezoelectric diaphragm where the piezoelectric element is laminated on the substrate has a stiffness that is higher than that of a region of the adjacent piezoelectric diaphragm located toward the front-most side of the speaker where the piezoelectric element is laminated on the substrate.

* * * * *